US012607010B2

(12) United States Patent
Egan et al.

(10) Patent No.: US 12,607,010 B2
(45) Date of Patent: Apr. 21, 2026

(54) CONNECTING MEMBERS AND SYSTEM FOR MODULAR WALL JUNCTIONS

(71) Applicant: FELLOWES, INC., Itasca, IL (US)

(72) Inventors: Michael Egan, Chicago, IL (US); Shawn M. Applegate, Streamwood, IL (US)

(73) Assignee: FELLOWES, INC., Itasca, IL (US)

( * ) Notice: Subject to any disclaimer, the term of this patent is extended or adjusted under 35 U.S.C. 154(b) by 404 days.

(21) Appl. No.: 18/127,617

(22) Filed: Mar. 28, 2023

(65) Prior Publication Data

US 2023/0323662 A1 Oct. 12, 2023

Related U.S. Application Data

(60) Provisional application No. 63/328,756, filed on Apr. 8, 2022.

(51) Int. Cl.
*E04B 2/78* (2006.01)
*E04B 2/74* (2006.01)

(52) U.S. Cl.
CPC ..... *E04B 2/7818* (2013.01); *E04B 2/7407* (2013.01)

(58) Field of Classification Search
CPC .... E04B 2/7407; E04B 2/7422; E04B 2/7818; E04B 2/7854
USPC ..... 52/241
See application file for complete search history.

(56) References Cited

U.S. PATENT DOCUMENTS 2,962,133 A 11/1960 Kivett
2,963,131 A 12/1960 Brockway
3,092,219 A 6/1963 Young
3,193,061 A 7/1965 Downes
3,292,328 A 12/1966 Lewis et al.
3,371,454 A 3/1968 Anderson
(Continued)

FOREIGN PATENT DOCUMENTS

CA 2591075 A1 12/2008
CA 2516083 C 3/2013
(Continued)

OTHER PUBLICATIONS

International Search Report and Written Opinion issued in corresponding International Patent Application No. PCT/US2023/016640, dated Jul. 14, 2024.
(Continued)

*Primary Examiner* — James M Ference
(74) *Attorney, Agent, or Firm* — CUSHMAN PARTNERS, LLC

(57) ABSTRACT

A system and connector interconnects modular wall vertical frame members meeting at a junction. A first vertical frame member and a second vertical frame member each have a central section for mounting a wall panel. Each vertical frame member has a pair of lateral legs at the lateral edges thereof and a pair of inner legs extending inwardly. The inner legs are spaced laterally away from the lateral edges. Each vertical frame member also has a pair of interlocking members positioned inwardly of the central section. The interlocking members each having a laterally extending leg defining a laterally extending latch receiving space. The connector member has a head or heads for supporting parts and a latch or latches for securing parts, including trim members. The junctions may be corner or end-to-end.

20 Claims, 7 Drawing Sheets

(56) References Cited

U.S. PATENT DOCUMENTS 3,475,870 A 11/1969 Birum
3,585,771 A * 6/1971 Pinniger ..... E04B 1/215 52/251
3,590,542 A * 7/1971 Gallay ..... E04B 1/185 52/459
3,593,474 A * 7/1971 Neels ..... B44C 3/12 52/223.7
3,601,995 A * 8/1971 Seiz ..... E21D 11/15 405/152
3,671,063 A * 6/1972 Slayden ..... E04B 2/76 52/584.1
3,780,481 A * 12/1973 Tomkins ..... E04B 2/7881 52/282.4
3,821,868 A * 7/1974 Edwards ..... E04B 2/60 D25/61
3,848,382 A * 11/1974 Rensch ..... E04B 1/6154 52/263
3,868,800 A * 3/1975 Peterson ..... E04B 1/6158 403/408.1
3,869,867 A * 3/1975 Krings ..... E02D 5/04 405/282
3,909,059 A * 9/1975 Benninger ..... B62D 29/008 52/471
3,938,291 A * 2/1976 Criswell ..... E04B 2/967 52/204.597
4,016,688 A * 4/1977 Tiffin ..... B66C 23/701 414/718
4,065,904 A 1/1978 Taylor
4,129,970 A * 12/1978 Whitney ..... E04C 2/205 52/461
4,129,973 A * 12/1978 Keller ..... E04B 2/62 52/552
4,318,636 A * 3/1982 Thomas ..... E21D 11/083 405/153
4,318,637 A * 3/1982 Oger ..... E21D 11/15 405/153
4,435,935 A * 3/1984 Larrea ..... E04F 13/0889 52/471
4,449,346 A * 5/1984 Tremblay ..... E04B 1/617 52/471
4,455,801 A * 6/1984 Merritt ..... E04H 9/10 52/309.9
4,458,461 A 7/1984 Holley
4,497,148 A * 2/1985 Lopez ..... E04B 2/7448 52/239
4,570,402 A * 2/1986 Johnson ..... E04B 2/7818 52/282.4
4,570,408 A * 2/1986 Frascaroli ..... E04B 1/5831 52/843
4,585,131 A 4/1986 Crossman
4,667,450 A * 5/1987 Stefnik ..... E04B 2/7409 52/656.1
4,827,682 A * 5/1989 Gildehaus ..... E06B 7/28 52/201
5,125,201 A * 6/1992 Pieters ..... E04B 2/7455 52/468
5,233,803 A 8/1993 Bockmiller
5,393,114 A * 2/1995 Christensen ..... B60R 9/00 296/3
5,592,794 A 1/1997 Tundaun
5,802,789 A 9/1998 Goodman et al.
6,016,632 A * 1/2000 McGee ..... E06B 3/9636 52/584.1
6,112,485 A 9/2000 Beyer et al.
6,260,321 B1 7/2001 Rudduck
6,301,846 B1 10/2001 Waalkes et al.
6,418,671 B1 7/2002 DeRuiter et al.
D477,090 S * 7/2003 Thomsen ..... D25/60
6,591,557 B1 * 7/2003 Thomsen ..... E04D 3/08 52/DIG. 17
6,688,056 B2 2/2004 Von Hoyningen Huene et al.
6,883,277 B2 4/2005 Wiechecki et al.
7,707,790 B2 * 5/2010 Williams ..... E04B 2/7416 52/282.4
7,845,384 B2 12/2010 Goodman et al.
8,015,767 B2 9/2011 Glick et al.
8,024,901 B2 9/2011 Gosling et al.
8,327,805 B2 * 12/2012 Rogge ..... A01K 1/0064 119/493
8,601,749 B2 12/2013 Von Hoyningen Huene et al.
8,925,619 B2 1/2015 Frezouls et al.
9,010,045 B1 4/2015 Kopish
9,074,372 B2 * 7/2015 Laurin ..... F24S 25/67
9,249,567 B2 2/2016 Yu et al.
9,284,729 B2 3/2016 Von Hoyningen Huene et al.
9,312,411 B2 * 4/2016 Laurin ..... H10F 19/00
9,546,483 B2 1/2017 Gosling et al.
9,562,356 B2 * 2/2017 Israeli ..... E04D 3/363
9,593,481 B2 3/2017 Gosling et al.
9,650,785 B2 5/2017 Yu et al.
9,803,361 B2 10/2017 Von Hoyningen Huene et al.
9,856,644 B2 1/2018 Gosling et al.
RE46,929 E 7/2018 Gosling et al.
10,094,400 B2 * 10/2018 Tamiozzo ..... F16B 2/12
10,202,762 B2 * 2/2019 Sollohub ..... E06B 3/5427
10,301,821 B2 5/2019 Gosling et al.
RE47,693 E 11/2019 Gosling et al.
10,787,829 B1 9/2020 Meyer et al.
10,822,788 B2 * 11/2020 Knapp ..... F16B 2/14
10,920,418 B2 2/2021 Gosling et al.
10,927,545 B2 2/2021 Von Hoyningen Huene et al.
11,021,872 B2 6/2021 Gosling
11,085,184 B2 8/2021 Gosling et al.
11,371,280 B2 * 6/2022 Bernhagen ..... E06B 3/08
11,555,309 B2 * 1/2023 Kinnunen ..... E04D 3/366
11,584,041 B2 * 2/2023 Bernhagen ..... B29B 15/12
11,952,773 B2 * 4/2024 Gosling ..... E04B 2/7453
12,410,611 B2 * 9/2025 Applegate ..... E04B 2/7422
2001/0025463 A1 10/2001 Rudduck
2007/0039259 A1 2/2007 Macdonald
2008/0104922 A1 5/2008 Glick
2009/0109575 A1 4/2009 McCoy-Deedler
2021/0172168 A1 6/2021 Von Hoyningen Huene et al.
2021/0340772 A1 11/2021 Gosling et al.
2021/0386197 A1 12/2021 Merten

FOREIGN PATENT DOCUMENTS

CN 201074371 Y 6/2008
CN 202298987 U 7/2012
CN 210134604 U 3/2020
CN 112227621 A 1/2021
CN 113175153 A 7/2021
CN 215483658 U 1/2022
CN 216276295 U 4/2022
CN 114809511 A 7/2022
CN 217053761 U 7/2022
DE 20022989 U1 10/2002
DE 202018103900 U1 10/2018
DE 102017128311 A1 5/2019
EP 0 146 409 A2 6/1985
FR 2 453 304 A1 10/1980
GB 2 042 670 A 9/1980
GB 2367569 A 4/2002
GB 2510750 A 8/2014
WO 2000024981 A1 5/2000
WO 2007145882 A2 12/2007
WO 2021119167 A1 6/2021

OTHER PUBLICATIONS

International Search Report and Written Opinion issued in International Application No. PCT/US2023/016640, dated Jul. 10, 2023.

* cited by examiner

CONNECTING MEMBERS AND SYSTEM FOR MODULAR WALL JUNCTIONS

CROSS-REFERENCE TO RELATED APPLICATIONS

This application claims the benefit under 35 USC 119(e) of prior U.S. Provisional Patent Application Ser. No. 63/328,756, filed Apr. 8, 2022, which is hereby incorporated by reference in its entirety.

FIELD OF THE INVENTION

The present application relates to connecting members for securing vertical members of modular wall sections at junctions.

SUMMARY OF THE INVENTION

One aspect of the application provides a system for interconnecting modular wall vertical frame members meeting at a corner junction. The system comprises a first vertical frame member and a second vertical frame member, each vertical frame member having a mount for mounting a wall panel. Each vertical frame member has a pair of lateral legs at the lateral edges thereof and a pair of inner legs extending inwardly. The inner legs are spaced laterally away from the lateral edges. Each vertical frame member also has a pair of interlocking members positioned inwardly of the mount. The interlocking members each have a laterally extending leg defining a laterally extending latch receiving space.

A connector member has a body structure with a head extending therefrom and a pair of legs with latches thereon extending therefrom opposite the head. The legs with the latches extending to form a general V-shape. The legs with the latches are configured to be received in the latch receiving spaces of the vertical frame members in a latching engagement to secure the vertical frame members in a corner junction relationship. The head is configured to be received between the inner legs and lateral legs of the vertical frame members to support the corner junction relationship.

Another aspect of the present application provides the connector member per se for interconnecting modular wall vertical frame members meeting at a corner junction.

Another aspect of the application provides a system for interconnecting modular wall vertical members meeting at an end-to-end junction. The system comprises a first vertical member and a second vertical member, at least one of the vertical members being a vertical frame member having a mount for mounting a wall panel. Each vertical member has a pair of lateral legs at the lateral edges thereof and a pair of inner legs extending inwardly, the inner legs being spaced laterally away from the lateral edges. Each vertical member also has a pair of interlocking members positioned inwardly of the inner legs. The interlocking members each have a laterally extending leg defining a laterally extending latch receiving space. A vertical fascia trim member is for covering a space formed between the vertical members. The fascia trim member has a pair of lateral legs at the lateral edges thereof and a pair of inner legs extending inwardly. The inner legs are spaced laterally away from the lateral edges. The fascia trim member also has a retainer member between the inner legs thereof.

A connector member has a body structure with a pair of legs with heads thereon extending therefrom and a fascia retainer member extending therefrom between the pair of legs. The legs with the heads extend to form a general V-shape. The connector member also has a pair of legs with latches thereon extending therefrom opposite the fascia retainer member. The legs with the latches are configured to be received in the latch receiving spaces of the vertical members in a latching engagement to secure the connector member to the vertical members. The fascia retainer member is configured to engage the retainer member of the fascia trim member in a latching engagement to secure the fascia trim member over the space formed between the vertical members. The heads are configured to be received between the inner legs and lateral legs of the vertical members and the fascia trim member to support the fascia trim member.

Another aspect of the present application provides the connector member per se for interconnecting modular wall vertical members.

Another aspect of the present application provides an installed modular wall system including any of the features discussed to form a junction.

Another aspect of the present application provided a covering for a terminal end portion of a wall section having a vertical frame member where a fascia trim member positioned as a vertical frame member adjacent the wall section frame member and a pair of fascia trim members are connected to create and end-to-end junction therebetween.

Other objects, features, and advantages of the present invention will become apparent from the following detailed description, the accompanying drawings, and the appended claims.

DETAILED DESCRIPTION OF THE ILLUSTRATED EMBODIMENT(S)

Figure 1:
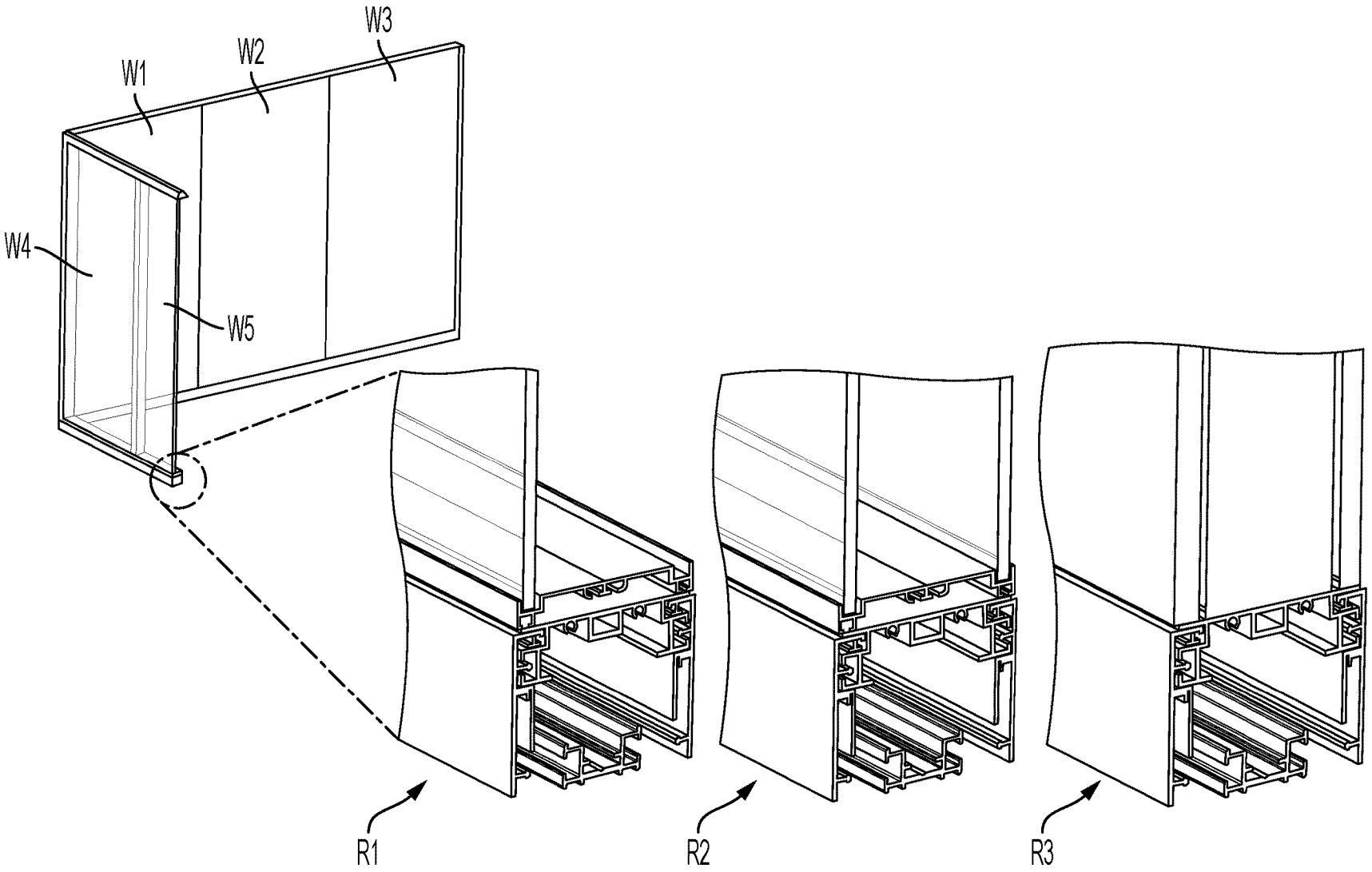
FIG. 1 shows an example of a partially constructed office space formed from modular walls where walls meet at corner and end-to-end junctions.

The present application discloses provides systems and connector members for interconnecting modular wall vertical members, such as those meeting at a corner or end-to-end junction. FIG. 1 shows an example of a partially constructed office space formed from modular walls where walls meet at corner and end-to-end junctions. The space constructed need not be office related, and can be any setting, including residential, factory, educational, or otherwise. The office example is not limiting and is used for illustrative context.

Modular walls typically have a frame supporting panels of a variety of styles. Such panels may be wood, frameless glass (or another translucent or transparent material), framed glass, gypsum, fiberboard, canvas exterior, metal, etc. Such panels can also be functional components, like a whiteboard, display screen, etc. The types of modular walls and panels thereof is not limiting and the examples mentioned herein are exemplary only.

In FIG. 1, for example, wall sections W1, W2 and W3 are shown meeting at end-to-end junctions, and wall sections W1 and W4 are shown meeting at a corner junction. A partial, cut-away wall section W5 also shown meeting wall section W4 at an end-to-end junction. Wall sections W1-W3 are shown as having wood, fiberboard or other non-transparent material, while wall sections W4 and W5 are glass wall sections. FIG. 1 also shows a detailed view of different options for a bottom rail of wall sections W4 and W5, including a version R1 for mounting a single pane of glass, a version R2 for mounting two panes of glass, and a version R3 where the glass is replaced with two solid wood or fiberboard panels with acoustic dampening material therebetween (which may be used for wall sections W1-W3). These examples are not limiting, and are provided simply to provide context of the types of wall sections that can be connected together using the features described herein below.

Figure 2:
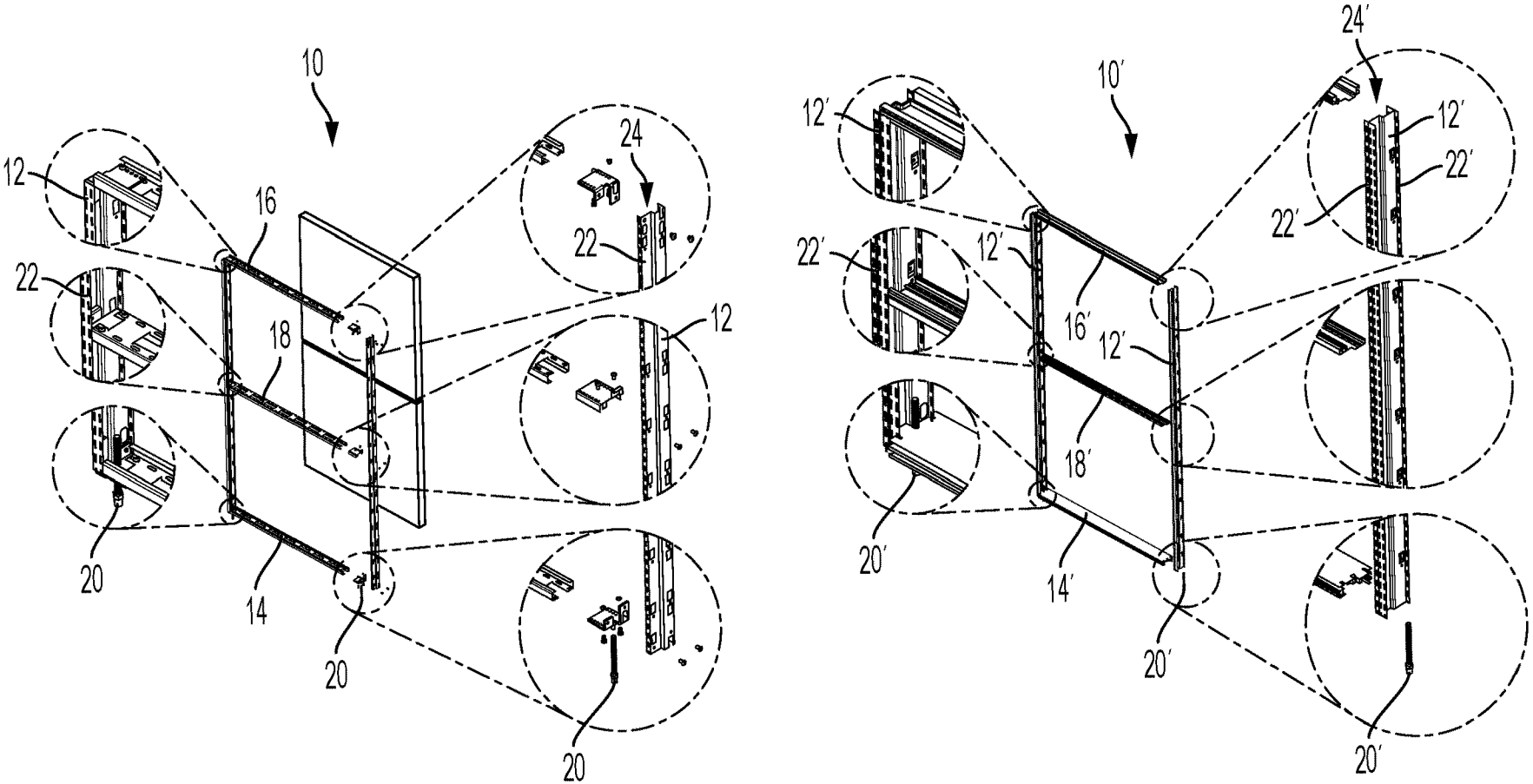
FIG. 2 shows examples of internal frames used for mounting wall panels.

FIG. 2 shows examples of internal frames 10 and 10' used for mounting wall panels made of wood, fiberboard, gypsum, etc., or framed glass panels. The frame may come pre-assembled or be assembled at the installation site. Corresponding parts for the second example 10' are denoted with a ' on the reference number. The frame 10, 10' generally includes a pair of vertical rail members 12, 12', a bottom rail 14, 14', a top rail 16, 16' and at least one intermediate horizontal rail 18, 18'. These rails are assembled together using any types of fasteners. The bottom rail 14 or vertical rail member 12' has a height adjuster 20, 20', respectively, that can be used to vertically adjust a height of the internal frame member 10, 10' to better match the ceiling and align components as needed.

The vertical frame members 12, 12' each have a series of vertically arranged openings 22, 22' for mounting wall panels 24 during assembly. These openings 22, 22' may also be used for mounting other accessories. The frame members 12, 12' may also have a stepped configuration 24, 24' with two web sections connected by a transition section, with the vertical frame members 12, 12' of each frame 10, 10' being inverted with respect to one another. That is, the stepped configuration on one vertical frame member is flipped around (about its vertical axis) with respect to the other, so that when two internal frames of the same construction (or at least the same vertical frame member type) meet end-to-end their adjacent frame members can interface with each other easily without substantial spacing therebetween (see FIG. 3). This provides an easy ability for the wall sections of the same type (or with the same vertical frame members) to be connected in end-to-end relation.

The details in FIG. 2 are not intended to be limiting, and instead are provided solely as an example for providing context for the features discussed below, including other junction situations.

Figure 3:
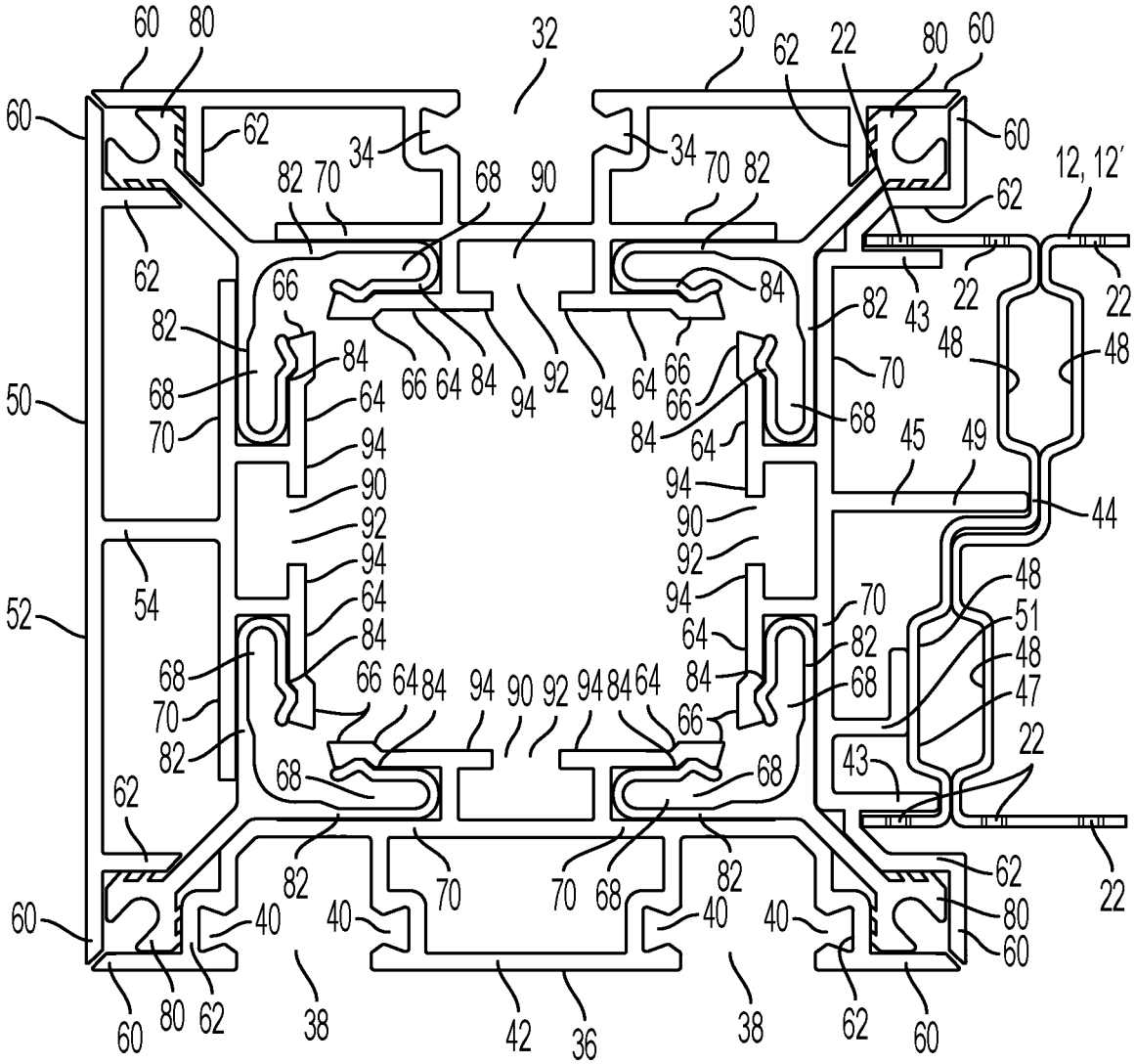
FIG. 3 illustrates four corner junctions between four different vertical frame members that may be included in the system.
Figure 4:
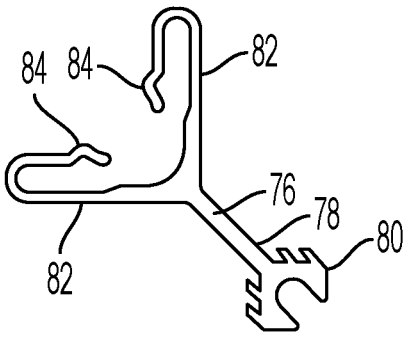
FIG. 4 is a cross-section or end view of a connector member shown in FIG. 3.
Figure 5:
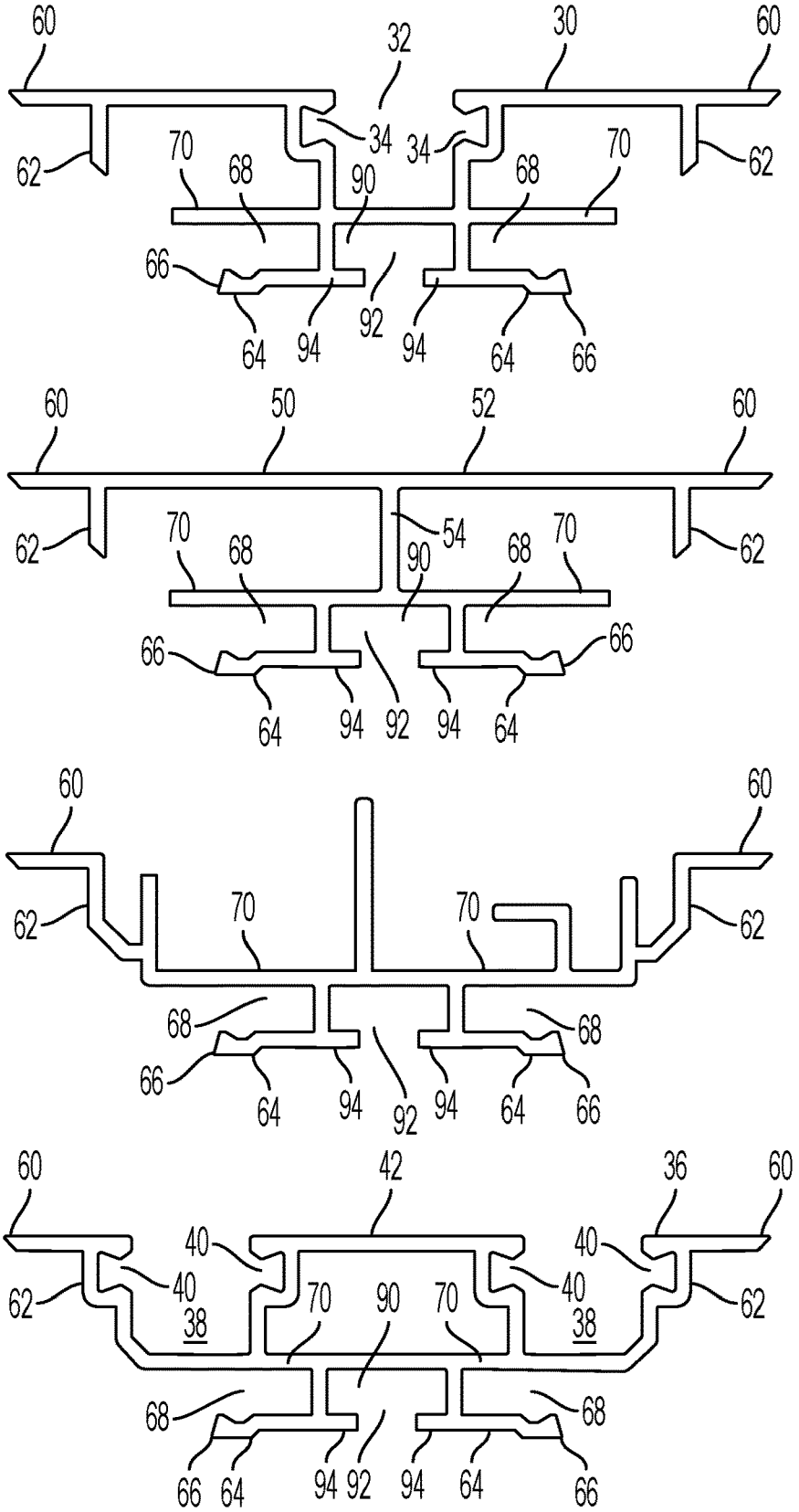
FIG. 5 shows cross-sections or end views of the vertical frame members shown in FIG. 3.

FIGS. 3-5 relate to a connector and system for establishing a corner junction where two wall sections meet at a corner. FIG. 3 illustrates four corner junctions between four different vertical members that may be included in the system. FIG. 3 is for illustrative purposes to show how a corner can be made, and it should be understood often only two wall sections are involved in a corner junction.

At the top of FIG. 3, a vertical frame member 30 for a single pane glass panel wall section is shown, which has a central section with a mount in the form of a channel 32 for receiving a single glass panel (not shown). The channel 32 may also have smaller optional channels 34 for receiving a gasket (not shown) to seal the glass panel. Other components common to the various vertical frame members will be discussed later.

At the bottom of FIG. 3, a vertical frame member 36 for a double pane glass panel wall section is shown, which has a central section with a mount in the form of two channels 38 each for a respective glass panel with two optional gasket channels 40 for receiving a gasket to seal the glass panels. An optional web 42 extends between the inner side walls of the two channels 38.

At the right of FIG. 3, a vertical frame member 44 for a wall having its own internal frame with a vertical frame member, like the wall in FIG. 2, and any other wall having frame components creating an internal frame. The example at the right of FIG. 3 shows the frame member 44 including a main body 45 with a member 47 serving as a mount, which is of the same type or cross-section as the frame member 12, 12' (a stepped configuration) used for the internal frame of a wall section. The frame member 44 can thus be connected to the end of a wall section using connections between member 47 and the frame member 12, 12' in a manner similar to how the frame members of wall sections are connected at end to end junctions, with fasteners connecting member 47 (and thus in turn the frame member 44) to the frame member 12, 12' of the wall section. That establishes mounting of the panel to the frame member 44 indirectly through the panel's frame. For further details in this regard, reference may be made to U.S. Provisional Appln. Ser. No. 63/327,389, which is incorporated herein in its entirety for all purposes. The illustrated body 45 also has a longer supporting wall 49 and a shorter supporting wall 51 to support sections of the member 47. The member 45 also has a pair of flanges or legs 43 to which flanges on the member 47 is attached, such as by fasteners, including snap-fits, adhesive, nuts/bolts and the like. The attachment between the members 45 and 47 may be done prior to installation, such as at the manufacturing site, or may be done during installation. For example, the member 47 may be attached to the frame member 12, 12' of the wall section first, and then the member 45 is attached thereto.

In other embodiments, the frame member 44 can be made in one piece for attachment to any vertical frame member of a wall section. For example, a frame member 44 could have a stepped configuration designed into it as one continuous part, thus avoiding the addition of a separate part like 47 to serve as its mount for the panel and its internal frame. If fasteners are used on the vertical frame member 12, 12' for connecting horizontal frame members, fastener receiving portions or pockets may be added to accommodate those fasteners without interference, as shown in the aforementioned incorporated application (which would be similar to those marked 48 on 12/12' and 47). Other designs where a stepped configuration is not needed may also be used, and thus the mount part may have any configuration. Such an embodiment can be attached directly to the vertical frame member of a wall section for facilitating establishment of a corner junction. In other embodiments, the frame member 44 can be included in the internal frame of a wall section, with it mount for the panel(s) being where the panel mounts directly. Thus, the present application is not limited to the details illustrated.

In the illustrated design, the frame member 44 may be attached to a vertical frame member 12, 12' of a wall section when a corner junction is involved. This is preferred to enable the wall sections to be made with the same vertical frame members 12, 12' throughout, and adding the vertical frame member 44 at only those locations where a corner junction is formed (which will be much fewer). It is also possible in some embodiments to create the vertical frame member 44 so that the wall panels can be mounted directly thereto, such that it need not be attached to another vertical frame member 12, 12' (in other words, it can be modified to include the panel mounting parts of and be used in place of a vertical frame member 12, 12' instead of being attached to it, and hence its mount for a panel or the panels may have that structure).

Any type of mount for a single panel or multiple panels may be used, and the particular structure is not limited to any configuration. The mount is generally on the outer side with respect to a junction (which is also the inner side with respect to the wall section meeting at that junction). Generally, directions like inner and outer (or terms of similar import) as used herein will be with reference to the junction unless the context dictates otherwise. Similarly, the direction lateral refers to the lateral direction of a part relating to a junction, which is also in the same direction as a thickness or depth of an associated wall section, unless the context dictates otherwise.

At the left of FIG. 3 is a fascia trim member 50. A vertical frame member is a vertical member that serves a predominantly structural support or interconnection role, like supporting a panel, while a fascia trim member like member 50 (and any others) is a vertical member that serves a predominantly ornamental role and can be removed or replaced without disassembly of the wall section. The trim member 50 has a flat exterior wall 52 and optionally a supporting central web 54 for supporting the wall 52. This fascia trim member 50 is used for concealing the inner area of the corner junction, and specifically a pair is typically used. The details of how the trim member 50 is used will be discussed in further detail below. It should be understood that a frame member may have some aesthetic aspects and surfaces that can be seen that are finished as trim. However, that would not change the frame member's role of providing structural support or a connection. For example, on members 30 and 36 because the surfaces on opposing outer sides of the channels 32, 38 may be visible, those surfaces may be finished as trim surfaces, although the members 30 and 36 would still be regarded predominantly serving the structural purpose of retaining the glass pane(s). Similarly, on frame member 44, the surfaces extending away from the part of an internal frame (i.e., the surfaces on member 44 extending out to flanges 60) may likewise be visible and finished as trim. Frame member 44, however, still serves a predominantly structural role because it establishes the connection between the internal frame of that wall section and the corner junction. It is also possible in certain installation configurations that no part of frame member 44 is visible if a panel mounted to the internal frame covers those flanges 60, thus making member 44 entirely structural in purpose. Likewise, a trim member like trim member 50 (or any other trim member) can have parts performing a secondary structural role, like features for helping route wires or an opening for a plug socket, while still predominantly performing an aesthetic function as trim. Thus, some members considered as structural frame members may have some trim or aesthetic aspects, while some ornamental trim members may have some structural aspects, each without changing how a person of ordinary skill in the art would understand its role.

Each of these members 30, 36, 44, 50 have common components on the inner face thereof (the side facing into to the corner junction). Specifically, each vertical member 30, 36, 44, 50 also has a pair of lateral legs 60 at the lateral edges thereof and a pair of inner legs 62 extending inwardly. The lateral legs 60 are shown as continuous with the face of the central section that receives a wall panel (or in the case of trim member 50 is exterior or outer trim surface), but may be offset or differently configured. The inner legs 62 are spaced laterally away from the lateral edges.

Each vertical member 30, 36, 44, 50 also has a pair of interlocking members 64 positioned inwardly of its central section. The interlocking members 64 each having a laterally extending leg 66 defining a laterally extending latch receiving space 68. These legs 66 are spaced from inner walls 70 of the members (inner referring to towards the corner junction) and are connected thereto at one end and have an opposing end free for enabling insertion into the space 68. These structures are also positioned inwardly of the inner legs 62 so that the insertion discussed below can take place without interference from the legs 62. As can be seen in the drawings, the legs 66 may have an undulating configuration, and detents, snap-fit features, other shaped features, or press or interference fit may also be used for the latching engagement on the surface inside the space 68. Latching as used herein broadly refers to any features that engage for secure connection between the components. Adhesives, pins, or other fasteners may also be used. These features may have any construction or configuration, and are not intended to be limiting.

These four vertical members 30, 36, 44, 50 are also shown in FIG. 5, showing them isolated from the connector member discussed below.

It should be understood that the vertical frame members 30, 36, 44 can be of any type for interfacing with a panel or panels of a wall section, and the illustrated configurations for such interfacing are not limiting (the function of the trim member 50 is discussed below). The frame members may be included as part of a pre-assembled internal frame for the wall sections (i.e., the frame is pre-assembled in advance so it can be stood up in place at the installation site, including being pre-assembled at a factory location for shipment to the installation site). In some embodiments, the entire wall section may be pre-assembled with the panels installed on the internal frame. In other embodiments, the various components of a wall section may come partially or completely disassembled, and be assembled as part of the installation process. Thus, the present application is not limited to any particular type of wall sections used to create the modular wall. In other embodiments, the vertical frame member may be separate from a wall section's frame and be designed to receive and support lateral edges of the wall section frame. In some designs, the wall panel may be frameless, such as frameless glass panels, and the vertical frame members are configured to receive and support lateral edges of the panel.

In the illustrated embodiment, these members 30, 36, 44, 50 are roll-formed from metal, such as steel or aluminum. This is a preferred approach, but other forms of manufacturing may be used, such as extrusion, stamping (including progressive or sequential stamping) may be used. Similar other materials, like rigid plastics or composites may be used. For the trim members, if metal is used further polishing, finishing, or other enhancements may be done for aesthetics. Also, plastics, or combinations of material (like a plastic inner structure with finished outer surfaces of wood, metal, etc.) can be used for better appearance.

Any two of these frame members 30, 36, 44 from adjacent wall sections meeting at a corner junction may be regarded as part of a system comprising a first vertical frame member and a second vertical frame member, each of which is respectively part of adjacent wall sections. That is, one frame member is from one wall section and the other frame member is associated with another, adjacent wall section. The wall sections may of the same type of a different type, and the common inner components provides for modular connection as discussed below.

The system also includes a connector member 76, which is included at each corner junction in FIG. 3 and shown individually in FIG. 4 separate from the other components. The connector member 76 has a body structure 78 with a head 80 extending therefrom and a pair of legs 82 with latches 84 thereon extending therefrom opposite the head 80. The body structure 78 may have any configuration, and in the illustrated embodiment it is a planar central web. The legs 82 with the latches 84 extend to form a general V-shape. Typically, the angle is at 90 degrees, which is used for creating perpendicular corner junctions. If a non-perpendicular corner is desired a different angle may be used.

The legs 82 with the latches 84 are configured to be received in the latch receiving spaces 68 of the vertical frame members in a latching engagement to secure the vertical frame members in a corner junction relationship, as shown in FIG. 3. The head 80 is configured to be received between the inner legs 62 and lateral legs 60 of the vertical frame members to support the corner junction relationship. As shown, when the frame members meet at a corner junction, the legs 60, 62 of each meet to create a space bounded by the legs in which a head 80 is received. The head 80 helps support the corner junction relationship by maintaining proper distance between the lateral leg 60 of each frame member and the opposing inner leg 62 of the other frame member. This also helps prevent a lateral leg 62 from being deformed inwardly in the event it is bumped or otherwise struck or receives force against it after the wall is erected.

The latches 84 also have a configuration designed to latch within the spaces 68. In the illustrated embodiment, the latches 84 have a free leg that has resiliency with an outer surface matching the inner surfaces of the leg 66 of the interlocking members 64 to create the latched engagement. The latch 84 may have other configurations, including detents, snap-fit features, or any of the other options discussed above may be used.

The connector member 76 may be extruded as a single piece, preferably from plastic, although it can be extruded from metal as well. The connector member 76 can also be formed by other approaches, including injection molding, overmolding to a central component, or the like.

In some embodiments, the head 80 and legs 82 can extend the entire vertical length of the connector member 76 (particularly when extruded, as extruded parts generally have the same cross-section along their length). In other embodiments, the connector member 76 can have a plurality of sets of heads 80 and legs 82 spaced apart from one another in the vertical direction. This would provide connections at distinct locations, rather than along the entire length.

With the illustrated design, creating a corner junction is straightforward. The first wall section has the connector member 76 connected thereto with one of the latches 84 on a leg 82 inserted into the latch receiving space 68 and secured thereto, while the head 80 is positioned between the lateral and inner legs 60, 62 thereof. This may be done before or after the first wall section is erected. Once that is done and the first wall section is erected, the second wall section can be erected and connected by engaging its latch receiving space 68 over the other latch 84 on the other leg 82 so it is secured thereto, and its lateral and inner legs 60, 62 are positioned on the opposing sides of the head 80. This establishes the corner junction with relative ease. Additional fastening may be used if desired.

The head 80 has resilient fingers or barbs thereon, which are optional. These fingers may be compressed during assembly, which may help take up any tolerance differences between parts engaged therewith, ensure essentially equal pressure throughout the junction by providing dynamic tension, and/or assist in improving alignment. The fingers may also help provide additional sealing and block light/sound transmission through the junction. These are optional advantages and not limiting. The fingers may be integrally molded with the head 80 from the same material, or may be co-molded or co-extruded from a lower durometer material than the 80 to provide a part of varying durometer. These manufacturing options are also not limiting.

The same can be done to create a corner junction where three walls meet with two wall sections aligned end-to-end and another extending at an angle, which is typically perpendicular (which may be referred to as a T-junction or double-corner junction). Using FIG. 3 as a non-limiting example, the frame member 30 can be considered as associated with a wall section of the exterior wall of office A that has a single glass pane, the frame member 36 can be considered as associated with a wall section of the exterior wall of adjacent office B that has a double glass pane, and the frame member 44 can be considered as associated with a wall section of an interior wall that separates office A and B that has wood, fiberboard or other type of panels. The particular panels are examples, and not limiting, and any combination of walls and panels can be used. In this situation, the same process discussed above can be used to add an additional wall section to the junction. For example, using the example of FIG. 3, frame members 32 and 44 can be connected in the manner discussed above using a connector member 76 to create a corner junction therebetween at one lateral side of frame member 44, and then frame member 36 can be connected to the other lateral side of frame member 44 using another connector member 76 to create another corner junction therebetween in the manner discussed above. The order of connections is not limiting, and in this example frame members 36 and 44 could be connected together first before connecting frame member 32. Likewise, the wall sections associated with frame members 32 and 36 could be erected first so they are aligned in an end-to-end relation and then both connector members 76 could be used to connect the frame member 44 to both the frame members 32 and 36 during erection of the wall section associated with the frame member 44.

Figure 8:
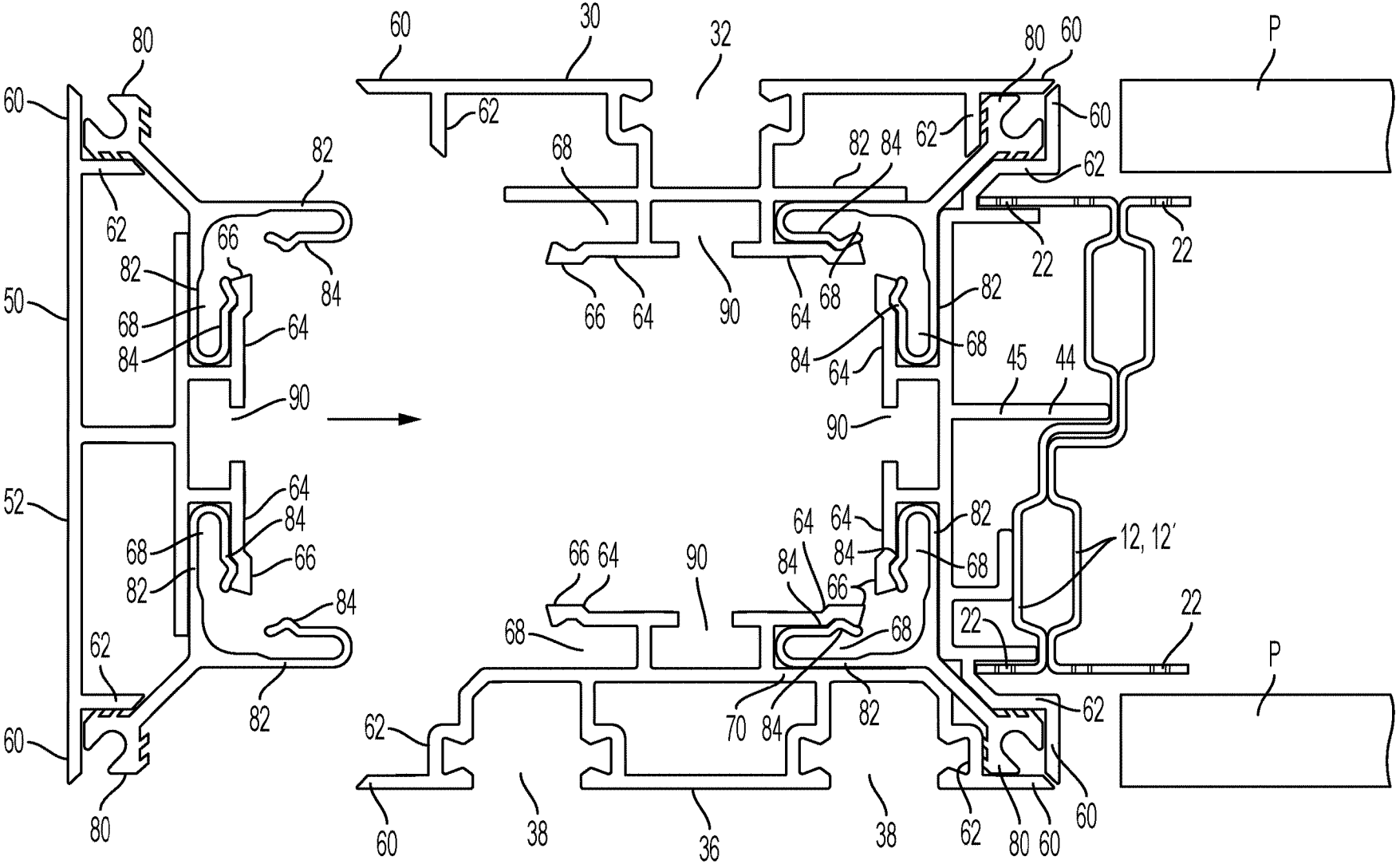
FIG. 8 shows part of the assembly process for a double corner T-junction where the members have been installed and the trim member 50 being installed.

FIG. 8 shows part of the assembly process for a double corner T-junction where the members 30, 36, and 34 are installed as discussed above with panels P on the wall section associated with member 44, and the trim member 50 being installed. The trim member 50 has the connector members 76 attached thereto, which have their latches 84 being inserted into the spaces 68 of the members 30, 36 as the trim member 50 is installed (shown as moving to the right in the drawing).

Each of the vertical members 30, 36, 44 and 50 may have a retainer structure 90 comprising a channel 92 with a pair of inwardly extending flanges 94. Additional components to be located inside the corner junction may have a pair of matching interfacing structures, such as T-shaped inserts, snap-fit features or any other insertable structure (which are at 90 degrees to one another on the rear/inner side of the trim for a perpendicular corner, or at another angle if the corner has a different angle) can be inserted into the channels 92 or connected to another retainer structure to retain the component in place. For example, a conduit for routing electrical wire, network cables, pipes or another water/fluid conduit, air conduits or the like could be connected inside the corner junction using such features. Also, additional connection structure could be added to those retainer structures with the same types of matching interfacing structures for securing the vertical members meeting at the corner junction together could also connect to such features within the confines of the corner junction.

As illustrated, in each vertical member 30, 36, 44, 50 the channel 90 and the inner walls 70 for the interlocking members 64 share a common wall extending laterally with respect to the frame member. That common wall is also essentially parallel to the walls of the central outer section, such as where channels 32, 38 are located (or the exterior surface of the illustrated trim member 50). That design is not limiting and any shape or configuration may be needed.

A non-limiting advantage of the illustrated design is that these connections between the interlocking members 64 and the latches 84, and the configuration of the head 80 and the lateral and inner legs 60, 62, is that after initial installation a height adjuster (or adjusters) on one or all wall sections meeting at the junction can still be used to make vertical height adjustments for any of the wall sections as needed. Specifically, those components on the vertical members have the same cross-section perpendicular to the vertical direction, thus allowing for vertical movement of one vertical frame member relative to the other without interference from the heads 80 and latches 84. This would typically be done before the installation of the trim member(s) 50 discussed below, but because each trim member 50 also has the same connective structure on the inner side it is also possible to make such adjustments after the trim is installed if needed.

When the corner junction is completed between two or three wall sections, trim may be used to cover the corner junction at the exterior angle side (referring to that side in the geometry sense). That may be unnecessary where that exterior angle side is against another structure and not exposed to view. For example, a modular wall structure can be built up against the pre-existing wall of a building such that the exterior angle side is facing that pre-existing wall, and hence no trim covering is needed. However, when the corner junction has its exterior angle side exposed, trim members such as the vertical trim member 50 may be used.

Continuing with the example in FIG. 3, an example of a junction between wall panels where a corner junction has been established by frame members 30 and 44 will be considered as a non-limiting example for context. With that corner junction is formed, two trim members 50 and three additional connector members 76 may be used. One trim member 50 will be connected to the frame member 30 using a connector member 76 in the same manner as described above, with that connector member 76 having (a) its latches 84 each connected the interlocking members 64 of both that first trim member 50 and the frame member 30, respectively and (b) its head 80 between the lateral and inner legs 60, 62 of both that first trim member 50 and the frame member 32 (which is shown in FIG. 3). The second trim member 50 will be connected to the other frame member 44 using another connector member 76 in the same manner as described above, with that connector member 76 having (a) its latches 84 each connected to the interlocking members 64 of both that second trim member 50 and the frame member 44, respectively, and (b) its head 80 between the lateral and inner legs 60, 62 of both that second trim member 50 and the frame member 44 (which essentially replaces the member 36 in FIG. 3 with another trim member 50). Both trim members 50 are also connected together by a third connector member 76 in the same manner with the latches 84, head 80, interlocking members 64 and legs 60, 62 not connected to the frame members 32, 44 playing the same role to connect the two trim members 50 together (again, the second trim member 50 is replacing member 36, and the connection at the lower left of FIG. 3 is the same).

A single trim member 50 can also be used at a T or double corner junction, such as the non-limiting example shown in FIG. 3. In that arrangement, the trim member 50 is added to the junction in the same manner, except only one is needed to conceal the inner space of the corner junction.

These trim members 50 can be easily removed and replaced to change styling/decoration of the modular wall. Likewise, if cable routing or other components are included inside the space of the junction, a trim member 50 can be removed for access and replaced. Also, if surfaces of a frame member, like member 30, 36 or 44, have visible surfaces, a frame member can also be removed and replaced to change the styling/decoration further. This would require additional steps, but because the panel itself can be re-used it is less expensive than replacing the entire wall section.

In another possible embodiment applicable to corner junctions for just two walls, a single fascia trim member having two exterior walls at an angle (typically 90 degrees for a perpendicular corner), or a rounded or faceted exterior wall can be used. Such a design would include the same general inner components, with legs 60, 62 and an interlocking member 64 at each lateral end thereof, and such a trim member would be connected at one lateral side to one vertical frame member using a connector member 76 and at the other lateral side to the other vertical frame member using another connector member 76 in the same manner as discussed above. For example, continuing with FIG. 3 as non-limiting context, if the frame members 30 and 44 are connected by a connector 76 in forming a corner junction, such a single trim member would be placed in the same general location as members 36 and 50, with the connector members 76 at each lateral end of the single trim member establishing connections to the interlocking members 64 of the single trim member and the frame members 30, 44 and having their heads 80 between the other sets of legs 60, 62 in the same manner as discussed above (here, other means the components on the lateral sides of the frame members 30, 44 that are not connected together by a connector member like that shown at the top right of FIG. 3). This design also eliminates the need for a fourth connector member (e.g., the lower left one in the example of FIG. 3, because the single trim member uses the connections at the top left and bottom right, and has its wall or walls extending therebetween).

Figure 6:
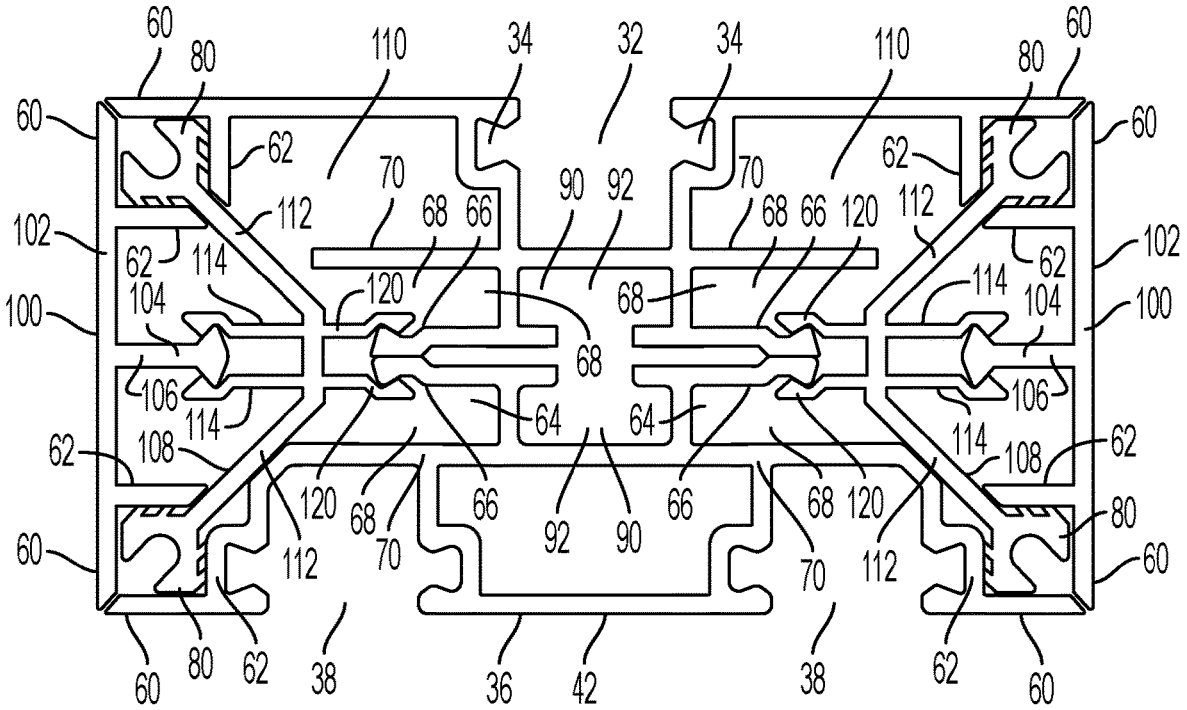
FIG. 6 illustrates an end-to-end junction between exemplary vertical frame members that may be included in the system.
Figure 7:
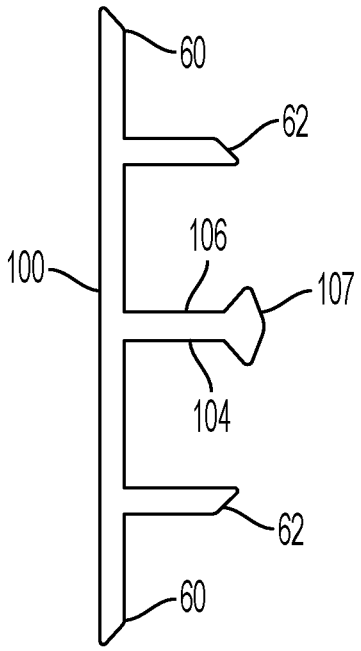
FIG. 7 is a cross-section or end view of a connector member shown in FIG. 6.

Another aspect of the present application provides a system for interconnecting modular wall vertical members meeting at an end-to-end junction. FIGS. 6 and 7 relate to this aspect of the invention. The vertical members at an end-to-end junction will typically be two vertical frame members, as shown in FIGS. 6 and 7. However, as will discussed below an end-to-end junction can also be formed between a vertical frame member of a wall section at the terminal end of a run (also called a peninsula wall, as discussed below) and a vertical trim member to provide finish for the terminal end. FIGS. 6 and 7 show the same vertical frame members 30, 36 discussed above as examples for context, and any combination of the frame members discussed above (or other frame members of different type) may be used. The examples in FIGS. 6 and 7 should not be considered limiting. For convenience, the same reference numbers for components of the exemplary frame members 30, 36 are used.

Any two frame members from adjacent wall sections meeting at an end-to-end junction may be regarded as part of a system comprising a first vertical frame member and a second vertical frame member, each of which is respectively part of the adjacent wall sections. The system comprises a first vertical frame member and a second vertical frame member, each vertical frame member having a central section with a mount for mounting a wall panel, as discussed above.

A vertical fascia trim member 100 is provided for covering a space formed between the vertical frame members 30, 36. One fascia trim member 100 may be used where only one side of the space between the frame members 30, 36 is exposed, and two vertical fascia trim members 100 may be used on opposing sides when both sides are exposed.

Each fascia trim member 100 has a pair of lateral legs 60 at the lateral edges thereof of and a pair of inner legs 62 extending inwardly and spaced laterally away from the lateral edges. The same reference numbers 60 and 62 from the corner junction context discussed above are used, as these structures serve the same purpose and hence the above discussion of those applies here equally.

The fascia trim member 100 illustrated also has a flat exterior wall 102 extending between the lateral edges. This wall 102 could have different configurations for ornamental purposes, such as a faceted or rounded shape, and may also include functional components also, such as an electrical connector or outlet or the like.

The fascia trim member 100 also has a retainer member 104 between the inner legs 62 thereof. The retainer member 104 may have any construction or configuration. In the illustrated embodiment, the retainer member 104 has an inwardly projecting member 106 extending inwardly from the wall 102 in the general center thereof and a head 107 on the free end thereof. As will be discussed below, the head 107 is enlarged to provide for a latching engagement with a connector member 108. Other constructions or configurations may be used. For example, the parts that latch could be reversed between the trim member 100 and the connector member 108, the engagement could use other forms of latching, such as other detents, snap-fits, press/interference fit or other types of interlocking connections.

The fascia trim member 100 may be made in the same manner as the other members discussed above.

Each connector member 108 has a body structure 110 with a pair of legs 112 with heads 80 thereon extending therefrom and the legs 112 with the heads 80 extend to form a general V-shape. The reference number 80 is used to reflect that the heads 80 on these legs 112 perform the same function as the head 80 on the corner junction discussed above, namely they are each configured to be received between the inner legs 62 and lateral legs 60 of the vertical frame members 30, 36 and the associated fascia trim member 100 to support the fascia trim member 100. The discussion above regarding the head 80 thus applies here equally, except that this connector member 100 has two instead of one. The connector member 108 may be formed in the manner described above for the connector member 76.

Each connector member 108 also includes a fascia retainer member 114 extending therefrom between the pair of legs 112. The fascia retainer member 114 is configured to engage the retainer member 106 of the fascia trim member 100 in a latching engagement to secure the fascia trim member 100 over the space formed between the vertical frame members 32, 36. In the illustrated design, the head 107 of the retainer member 106 on the trim member 100 is enlarged so that when it is received between the legs used as the fascia retainer member 114 it is received in a latching engagement, and the ends of the legs 114 have detents to grasp the head 107 securely. This construction allows the trim member 100 to be removed and replaced after the modular wall is installed, which enables design upgrades for a change of appearance as desired. As mentioned above, the engagement between the retainer members 106 and 114 may be of any type, including being reversed or using other structures, and are not limited to the illustrated design.

The connector member 108 also has a pair of legs 120 with latches thereon extending therefrom opposite the fascia retainer member 114. The legs 120 with the latches are configured to be received in the latch receiving spaces 68 of the vertical frame members 30, 36 in a latching engagement. In the illustrated design, the latches on the legs 120 engage the corresponding latching features on the inside of the legs 66 defining the latch receiving spaces 68. This latching may also be enhanced in the illustrated design where the legs 66 of the two adjacent frame members 30, 36 are abutting so that both can be received in the space between the legs 120. The resiliency of the material forming the legs 120 may be used to further enhance the latching. Again, as mentioned above, any types of retention may be used, and the disclosed approach is not considered limiting.

In some embodiments, the legs 120 may be sufficiently robust to be primarily responsible for securing the vertical frame members 30, 36 together in the end-to-end junction relationship. In other embodiments, the legs 120 may play a smaller role, such as providing additional securement in addition to other securement. For example, the two frame members 30, 36 may be secured together by a connecting structure secured to each of the retainer structures 90, or they may be secured by other types of fasteners, such clips, screws, nuts/bolts, or the like. In some embodiments, the legs 120 may perform essentially no role in securing the vertical frame members 30, 36 together, and may just serve the function of connecting the connector member 108, and in turn the trim member 100, to the frame members 30, 36.

As can be seen in FIG. 6, the end-to-end junction is formed by positioning the vertical frame members 30, 36 (or any two frame members) adjacent one another in end-to-end relation. This may be done before or after wall panels are installed thereto. The frame members 30, 36 are secured in the end-to-end relationship in any manner as discussed above. With the frame members erected, a trim member 100 can be attached to in the manner illustrated in FIG. 6. For example, the connector member 108 can be connected to the trim member 100 by engaging the retainer members 106 and 114 together, and then the trim member 100 can be installed by engaging the latches on the legs 120 in the receiving spaces 68 on one side of the adjacent vertical frame members 30, 36. The heads 80 will be received between the corresponding legs 60, 62 in the same manner as discussed above as the trim member 100 is installed. Alternatively, the connector member 108 can be installed first by engaging the latches on the legs 120 in the receiving spaces 68, and then trim member 100 can be installed by moving the trim member 100 into its installed position with the retainer members 106 and 114 engaging one another. If two trim members 100 are desired on both sides, then both can be installed using either approach, resulting in the configuration shown in FIG. 6.

The same non-limiting advantage discussed above of allowing one wall section to be adjusted vertically with respect to another at the junction applies equally to the end-to-end junction as well, which can take place after trim the trim is installed if needed.

As another alternative, the trim members 50 and 100 can be used together at a free terminal end of a wall section, which may be referred to peninsula wall section because the wall section extends out to a free end. In such an arrangement, the trim member 50 would be arranged as a vertical member in an end-to-end junction with the vertical frame member at the free end of the wall section, and a pair of the trim members 100 would be used in the same manner as shown in FIG. 6 connected therebetween in the same manner. The end-to-end junction is of the same type, except is between the vertical frame member of a wall section and the vertical trim member 50 (rather than another wall section). In the context of FIG. 6 as an example, if the vertical frame member 30 were at the free end of a wall section, the adjacent frame member 36 in the drawing would be replaced by the trim member 50 described previously with respect to the corner junction and the trim members 100 would have the same position. The connecting approach using the connector members 108 is generally the same and need not be repeated. This would conceal the free end of the wall section within the three trim members using the same modular components.

The foregoing embodiments have been provided solely to illustrate the structural and functional principles of the present invention and are not intended to be limiting. To the contrary, the present invention includes all substitutions, modifications, alterations and equivalents within the spirit and scope of the following claims.

What is claimed is:

1. A system for interconnecting modular wall vertical frame members meeting at a corner junction, the system comprising:

a first vertical frame member;

a second vertical frame member;

each of the first and second vertical frame members having a mount for mounting a wall panel;

each of the first and second vertical frame members having lateral edges;

each of the first and second vertical frame members having a pair of lateral legs at the lateral edges thereof;

each of the first and second vertical frame members also having a pair of interlocking members positioned inwardly of the mount, the pair of interlocking members each having a laterally extending leg defining a laterally extending latch receiving space;

a connector member having a body structure with a pair of legs with latches thereon extending therefrom, the pair of legs with the latches extending to form a general V-shape, wherein the pair of legs with the latches are configured to be received in the latch receiving spaces of the vertical frame members in a latching engagement to secure the vertical frame members in a corner junction relationship, wherein the body structure of the connector member includes a head configured to be received between portions of the vertical frame members to support the corner junction relationship, and wherein, in each of the first and second vertical frame members, the laterally extending legs of the pair of interlocking members are substantially parallel to the pair of lateral legs.

2. A system for interconnecting modular wall vertical frame members meeting at a corner junction, the system comprising:

a first vertical frame member;

a second vertical frame member;

each of the first and second vertical frame members having a mount for mounting a wall panel;

each of the first and second vertical frame members having lateral edges;

each of the first and second vertical frame members having a pair of lateral legs at the lateral edges thereof and a pair of inner legs extending inwardly, the pair of inner legs being spaced laterally away from the lateral edges;

each of the first and second vertical frame members also having a pair of interlocking members positioned inwardly of the pair of inner legs, the pair of interlocking members each having a laterally extending leg defining a laterally extending latch receiving space;

a connector member having a body structure with a head extending therefrom and a pair of legs with latches thereon extending therefrom opposite the head, the pair of legs with the latches extending to form a general V-shape, wherein the pair of legs with the latches are configured to be received in the latch receiving spaces of the vertical frame members in a latching engagement to secure the vertical frame members in a corner junction relationship, and wherein the head is configured to be received between the pair of inner legs and the pair of lateral legs of the vertical frame members to support the corner junction relationship, wherein the mount for mounting the wall panel comprises at least one channel configured to receive a glass panel wall section therein, and wherein the at least one channel includes a plurality of small channels that are configured to receive a gasket to seal the glass panel wall section.

3. The system of claim 2, wherein the wall panel includes a single pane glass panel wall section, and wherein one of the first vertical frame member and the second vertical frame member includes a central section with the mount comprising the channel for mounting the single pane glass panel wall section and with the gasket channel for receiving the gasket to seal the glass panel wall section.

4. The system of claim 2, wherein the wall panel includes a double pane glass panel wall section, and wherein one of the first vertical frame member and the second vertical frame member includes a central section with the mount comprising two channels, each of the two channels for mounting a respective glass panel wall section of the double pane glass panel wall section, and with two gasket channels for receiving a gasket to seal the glass panel wall sections.

5. The system of claim 2, wherein one of the first vertical frame member and the second vertical frame member is configured for a wall having an internal frame with a vertical frame member, wherein one of the first vertical frame member and the second vertical frame member includes a main body with a member serving as the mount, and wherein the main body includes a long supporting wall and a short supporting wall to support sections of the member.

6. The system of claim 2, wherein, for each of the first and second vertical frame members, the laterally extending leg is spaced from an inner wall of the respective vertical frame member of each of the first and second vertical frame members and is connected thereto at one end of the laterally extending leg and has an opposing end free for enabling insertion of the leg with the latch of the connector member into the latch receiving space of the respective vertical frame member, and wherein the laterally extending leg is positioned inwardly of the inner leg so that an insertion of the leg with the latch of the connector member into the latch receiving space of the vertical frame member takes place without interference from the respective inner leg of the pair of inner legs.

7. The system of claim 2, wherein the laterally extending leg includes undulating portion, detent portion, snap-fit portion, press fit portion and/or interference fit portion on a surface inside the latch receiving space of the vertical frame member, wherein the undulating portion, detent portion, snap-fit portion, press fit portion and/or interference fit portion are used for the latching engagement to secure the vertical frame members in the corner junction relationship.

8. The system of claim 2, wherein the head of the connector member helps support the corner junction relationship by maintaining a predetermined distance between one of the pair of lateral legs of each of the first and second vertical frame members and one of the pair of opposing inner legs of the other of the first and second vertical frame members, this configuration also helps prevent one of the pair of lateral legs from being deformed inwardly in an event one of the pair of lateral legs receives force against one of the pair of lateral legs after modular wall is erected.

9. The system of claim 2, wherein the latch of the connector member includes a free leg that resiliently engages with an outer surface matching an inner surface of the laterally extending leg of the interlocking member to create the latching engagement, and wherein the latch of the connector member includes undulating portion portion, detent portion, snap-fit portion, press fit portion and/or interference fit portion.

10. The system of claim 2, wherein the connector member is a molded integral piece including the body structure with the head and the pair of legs with latches.

11. A connector member for interconnecting modular wall vertical frame members meeting at a corner junction, the modular wall vertical frame members each having a mount for mounting a wall panel, lateral edges, a pair of lateral legs at the lateral edges thereof, wherein each modular wall vertical frame member also has a pair of interlocking members positioned inwardly of the mount, the pair of interlocking members each having a laterally extending leg defining a laterally extending latch receiving space;

the connector member comprising:

a body structure;

a pair of legs with latches thereon extending from the body structure, the pair of legs with the latches extending to form a general V-shape;

wherein the legs with the latches are configured to be received in the latch receiving spaces of the modular wall vertical frame members in a latching engagement to secure the modular wall vertical frame members in a corner junction relationship, wherein the body structure includes a head configured to be received between portions of the modular wall vertical frame members to support the corner junction relationship, and wherein, in each of the modular wall vertical frame members, the laterally extending legs of the pair of interlocking members are substantially parallel to the pair of lateral legs.

12. The connector member of claim 11, wherein the connector member is a molded integral piece including the body structure with the head and the pair of legs with latches.

13. A system for interconnecting modular wall vertical members meeting at an end-to-end junction, the system comprising:

a first vertical member;

a second vertical member;

at least one of the first vertical member and the second vertical member being a vertical frame member having a mount for mounting a wall panel;

each of the first vertical member and the second vertical member having lateral edges;

each of the first vertical member and the second vertical member having a pair of lateral legs at the lateral edges thereof and a pair of inner legs extending inwardly, the pair of inner legs being spaced laterally away from the lateral edges;

each of the first vertical member and the second vertical member also having a pair of interlocking members positioned inwardly of the pair of inner legs, the pair of interlocking members each having a laterally extending leg defining a laterally extending latch receiving space;

a vertical fascia trim member for covering a space formed between the first vertical member and the second vertical member, the vertical fascia trim member having a pair of lateral legs at the lateral edges thereof of and a pair of inner legs extending inwardly, the pair of inner legs being spaced laterally away from the lateral edges, the fascia trim member also having a retainer member between the pair of inner legs thereof;

a connector member having a body structure with a pair of legs with heads thereon extending therefrom and a fascia retainer member extending therefrom between the pair of legs, the pair of legs with the heads extending to form a general V-shape, the connector member also having a pair of legs with latches thereon extending therefrom opposite the fascia retainer member;

wherein the pair of legs with the latches are configured to be received in the latch receiving spaces of the first vertical member and the second vertical member in a latching engagement to secure the connector member to the of the first vertical member and the second vertical member, wherein the fascia retainer member is configured to engage the retainer member of the fascia trim member in a latching engagement to secure the fascia trim member over the space formed between the first vertical member and the second vertical member, and wherein the heads are configured to be received between the pair of inner legs and the pair of lateral legs of the first vertical member and the second vertical member and the fascia trim member to support the fascia trim member.

14. The system of claim 13, wherein the mount for mounting the wall panel comprises at least one channel configured to receive a glass panel wall section therein, and wherein the at least one channel includes a plurality of small channels that are configured to receive a gasket to seal the glass panel wall section.

15. The system of claim 13, wherein the wall panel includes a single pane glass panel wall section, and wherein the at least one of the vertical frame members includes a central section with the mount comprising a channel for mounting the single pane glass panel wall section and with a gasket channel for receiving a gasket to seal the glass panel wall section.

16. The system of claim 13, wherein the wall panel includes a double pane glass panel wall section, and wherein the at least one of the vertical frame members includes a central section with the mount comprising two channels, each of the two channels for mounting a respective glass panel wall section, and with two gasket channels for receiving a gasket to seal the glass panel wall sections.

17. The system of claim 13, wherein the fascia trim member includes a flat exterior wall extending between the lateral edges, wherein the retainer member of the fascia trim member has an inwardly projecting member extending inwardly from the wall and a head on the free end thereof, and wherein the head is enlarged to provide for the latching engagement with the connector member.

18. The system of claim 13, wherein the connector member is a molded integral piece including the body structure with the pair of legs with heads thereon, the fascia retainer member, and the pair of legs with latches thereon.

19. A connector member for interconnecting modular wall vertical members meeting at an end-to-end junction with a fascia trim member therebetween, at least one of modular wall vertical members being a vertical frame member having a mount for mounting a wall panel, lateral edges, a pair of lateral legs at the lateral edges thereof and a pair of inner legs extending inwardly, the pair of inner legs being spaced laterally away from the lateral edges, wherein each modular wall vertical member also has a pair of interlocking members positioned inwardly of the pair of inner legs, the pair of interlocking members each having a laterally extending leg defining a laterally extending latch receiving space; the fascia trim member being for covering a space formed between the modular wall vertical members, the fascia trim member having a pair of lateral legs at the lateral edges thereof of and a pair of inner legs extending inwardly, the pair of inner legs being spaced laterally away from the lateral edges, the fascia trim member also having a retainer member between the pair of inner legs thereof; the connector member comprising:

a body structure;

a pair of legs with heads thereon extending from the body structure;

a fascia retainer member extending from the body structure between the pair of legs, the legs with the heads extending to form a general V-shape;

a pair of legs with latches thereon extending from the body structure opposite the fascia retainer member;

wherein the pair of legs with the latches are configured to be received in the latch receiving spaces of the vertical members in a latching engagement to secure the connector member to the vertical members, wherein the fascia retainer member is configured to engage the retainer member of the fascia trim member in a latching engagement to secure the fascia trim member over the space formed between the vertical members, and wherein the heads are configured to be received between the pair of inner legs and the pair of lateral legs of the vertical members and the fascia trim member to support the fascia trim member.

20. The connector member of claim 19, wherein the connector member is a molded integral piece including the body structure with the pair of legs with heads thereon, the fascia retainer member, and the pair of legs with latches thereon.

* * * * *